US005161990A

United States Patent [19]

Ling et al.

[11] Patent Number: 5,161,990

[45] Date of Patent: Nov. 10, 1992

[54] UNIVERSAL PLUG FOR REPLACEMENT RECHARGEABLE BATTERY FOR TELEPHONES

[75] Inventors: Peter P. T. Ling, Scarborough, Canada; Andrew S. O. Ng, Jardine's Lookout, Hong Kong

[73] Assignee: GP Batteries (Malaysia) SDN BHD, Kuala Lumpur, Malaysia

[21] Appl. No.: 742,273

[22] Filed: Aug. 7, 1991

Related U.S. Application Data

[63] Continuation of Ser. No. 547,867, Jul. 2, 1990, abandoned.

[51] Int. Cl.[5] ..... H01R 33/04

[52] U.S. Cl. ..... 439/174; 439/173; 439/677; 439/746

[58] Field of Search ..... 439/218, 221, 223, 284, 439/290, 291, 717, 176, 677, 681, 746, 171-174, 511, 626, 628, 658, 660, 682

[56] References Cited

U.S. PATENT DOCUMENTS 3,493,915 2/1970 Cox ..... 439/511 X
4,191,917 3/1980 Brown et al. ..... 320/2
4,597,627 7/1986 Wondra et al. ..... 439/174
4,710,139 12/1987 Shichida ..... 439/746 X
4,790,763 12/1988 Weber et al. ..... 439/681 X
4,813,892 3/1989 Strate ..... 439/681

*Primary Examiner*—Larry I. Schwartz
*Assistant Examiner*—Julie R. Daulton
*Attorney, Agent, or Firm*—Donald S. Dowden

[57] ABSTRACT

A universal plug is provided for electrical connection with a receptacle having a configuration selected from a plurality of different configurations such that a conventional electric plug that mates properly with a receptacle having a first of the configurations is prevented from mating properly with a receptacle having a second of the configurations. The universal plug is formed with a first plug component and a second plug component, the first and second components being separable from each other so that each can be manipulated independently of the other for electrical connection to the receptacle. The universal plug will thus mate properly with a receptacle of the first configuration and will also mate properly with a receptacle of the second configuration.

10 Claims, 4 Drawing Sheets

UNIVERSAL PLUG FOR REPLACEMENT RECHARGEABLE BATTERY FOR TELEPHONES

This is a continuation of application Ser. No. 07/547,867, field Jul. 2, 1990 now abandoned.

BACKGROUND OF THE INVENTION

Field of the Invention

This invention relates to electric plugs and, more particularly, to a novel and highly-effective universal electric plug that will mate properly with electric receptacles that respectively have substantially different configurations.

A conventional electric plug that will mate properly with an electric receptacle of a first configuration will not in general mate properly with an electric receptacle of a second configuration that is substantially different from the first.

The problem of providing an electric plug that is properly configured to mate with the receptacle with which it is to be connected electrically arises in many environments. For example, international travelers who carry small plug-in electric appliances such as hair dryers and electric shavers must also carry adapters in order to employ the appliances in different countries that have household electric receptacles conforming to respectively different design specifications.

Even within the confines of a single country, the design specifications for electric receptacles in certain environments may not be standardized. For example, in the case of cordless telephones sold in the United States, wherein the handset is powered by a rechargeable battery pack, there are at least three different designs of plug receptacles.

There are an estimated 30 million cordless telephones in the United States, and the number is expected to increase annually in the foreseeable future. To allow for the replacement of the nickel-cadmium batteries in the telephone handset and to facilitate the separate disposal of the phone and the battery, most of the battery packs are provided with simple modular plugs for insertion into matching receptacles in the telephone handsets. There are, however, three major manufacturers of these plugs and sockets, namely JST, Molex and Mitsumi, and the plugs and mating receptacles made by these manufacturers are all shaped differently from one another. In order to accommodate the different requirements of different phones, there are already nearly two dozen configurations for assembling different unit cells into three- or four-cell battery packs. This, when combined with three different types of plugs and mating receptacles, makes for a bewildering series of replacement battery packs from which the consumer must select in order to replace a battery pack. It also creates serious inventory problems for manufacturers, distributors and retailers of replacement battery packs.

Because of the seriousness of the problem, many attempts have been made heretofore to develop universal plugs and other devices for simplifying the task of users in making electrical connections of various kinds with various pieces of equipment. Mention has already been made above of the adapters sold to international travelers by means of which they can use a small plug-in electric appliance such as a hair dryer or electric shaver designed, for example, for the U.S. market in various other countries where the electric receptacles for supplying household current are designed to different specifications.

A U.S. Pat. No. 4,191,917 to Brown et al. discloses a relatively flat, rectangular, box-shaped, rechargeable battery pack that has a multi-positionable plug with prongs. The plug can be appropriately positioned for recharging the pack by insertion Of the plug into either a European-type, deeply recessed receptacle, in a shallow recessed receptacle or in a flush, non-recessed United States-type receptacle. The pack is adapted to interchangeably fit into a pocket or any one of a plurality of pockets in a device in which the pack is to be employed. The prongs on the plug furnish voltage to the device when the pack is in a device pocket and furnish voltage to the pack during recharging. In a discharge mode, the plug is depressed and latched within the battery pack leaving only the prongs external of the battery pack for insertion into the device to be powered. The plug is likewise depressed for recharging in a flush-type receptacle. The pack discharge circuitry is actuated by a mating post in the housing of the device to be powered.

A U.S. Pat. No. 4,597,627 to Wondra et al. discloses a multiple signal cable system having a plurality of individual plug heads formed at the free ends of the cables for connection to a corresponding number of counter-piece contacts on a unitary adapter. The apparatus disclosed in the patent permits a multiple signal cable system having a plurality of individual plug heads formed at the free ends of the cables for connection to a corresponding number of counter-piece contacts on a unitary adapter. The invention disclosed in the patent permits a simplified manipulation of the multiple plug heads for connection with the adapter, while also affording rearrangement of the sequence of individual plug heads in accordance with the particular adapter. The individual plug heads are connected together in a consolidated, unitary arrangement by means of a housing collar having a sequence of side-by-side chambers for respectively securing the plug heads tightly therein. Lock means are provided on the housing and plug heads to secure the plug heads against relative movement and prevent the individual plug heads from falling out or being withdrawn from the unitary arrangement; however, the lock means are releasable to permit removal or rearrangement of the plug heads as needed.

None of the prior art described above provides a totally satisfactory solution to the problem of mating a plug properly with electric receptacles that respectively have substantially different configurations.

SUMMARY OF THE INVENTION

An object of the invention is to solve the problems of the prior art outlined above. In particular, an object of the invention is to provide a universal electric plug that will mate properly with electric receptacles that respectively have substantially different configurations.

Another object of the invention is to provide a universal electric plug for connecting a rechargeable battery pack to the electric circuitry of the handset of a cordless telephone.

Another object of the invention is to simplify for the consumer the problem of replacing a suitable replacement rechargeable battery pack for a cordless telephone.

Another object of the invention is to simplify for the manufacturer the manufacturing process and the inventory problem and to simplify for the distributor and retailer the inventory problem for replacement rechargeable battery packs for cordless telephones, thereby making it possible to provide such replacement battery packs to the consumer at a lower cost than would otherwise be necessary.

The foregoing and other objects are attained in accordance with the invention by the provision of a universal electric plug for electrical connection with a receptacle, said receptacle having a configuration selected from a plurality of different configurations such that a conventional electric plug that mates properly with a receptacle having a first of said configurations is prevented from mating properly with a receptacle having a second of said configurations, and said universal plug being formed with a first plug component and a second plug component, said first and second components being separable from each other so that each can be manipulated independently of the other for electrical connection to said receptacle, whereby said universal plug will mate properly with a receptacle of said first configuration and will also mate properly with a receptacle of said second configuration.

In accordance with an independent aspect of the invention, there is provided, in an electric plug for use with a handset of a cordless telephone wherein the handset (a) incorporates the plug, a receptacle electrically connected to the plug, handset circuitry, rechargeable battery means for powering the handset circuitry, first and second battery leads connecting the battery means to the plug, and first and second circuit leads connecting the handset circuitry to the receptacle and (b) is of a design selected from a plurality of designs such that the receptacle of a cordless telephone of a first of said designs is configured differently from the receptacle of a cordless telephone of a second of said designs so that a conventional plug that mates properly with a receptacle of a cordless telephone of said first design is prevented from mating properly with a receptacle of a cordless telephone of said second design, the improvement wherein the plug is formed with a first plug component connected to said first battery lead and a second plug component connected to said second battery lead, said first and second plug components being separable from each other so that each can be manipulated independently for electrical connection to said receptacle, whereby said plug will mate properly with a receptacle of a cordless telephone of said first design and will also mate properly with a receptacle of a cordless telephone of said second design.

The present invention contemplates the design and manufacture of a universal plug that is suitable for insertion into at least three popular sockets that are installed in over 90% of the cordless telephones currently on the market.

Instead of a plug that incorporates both the positive and negative terminals, the present invention provides two separate plug components respectively representing the positive and the negative terminals. By separating the positive and the negative terminals, it becomes possible to spatially rotate each separate plug component to match the orientation of the socket receptacle of the different manufacturers. Each manufacturer will generally include ridges or other protrusions or special geometry to ensure that the matching plug can be inserted only in the proper receptacle and in only one sense, so that the plug-in operation is "foolproof." In accordance with the invention, the plastic molding enclosing the wire gripping device is designed to accommodate the different ridges and protrusions and other special geometry of the different sockets.

It is of course necessary for the consumer to distinguish the correct terminal polarity when inserting a universal plug made in accordance with the invention. This is easy to do, since the positive and negative terminals are color-coded and can be distinguished by the red and black colors of the insulation of the wires (red designates positive polarity and black designates negative polarity). Furthermore, if the terminals are incorrectly inserted, the phone will not work, as evidenced by an LED which is generally provided. Under such circumstance, it will only be necessary for the installer to switch the two plug components around; no permanent damage to the phone or the battery pack will result, since only a low voltage is employed in a telephone handset.

In accordance with the invention, it is thus possible to simplify the inventory of battery packs and minimize the confusion in the replacement market.

BRIEF DESCRIPTION OF THE DRAWING

A better understanding of the objects, features and advantages of the invention can be gained from the following detailed description of the preferred embodiment thereof, taken in conjunction with the appended figures of the drawing, wherein.

DESCRIPTION OF THE PREFERRED EMBODIMENTS

Figure 1:
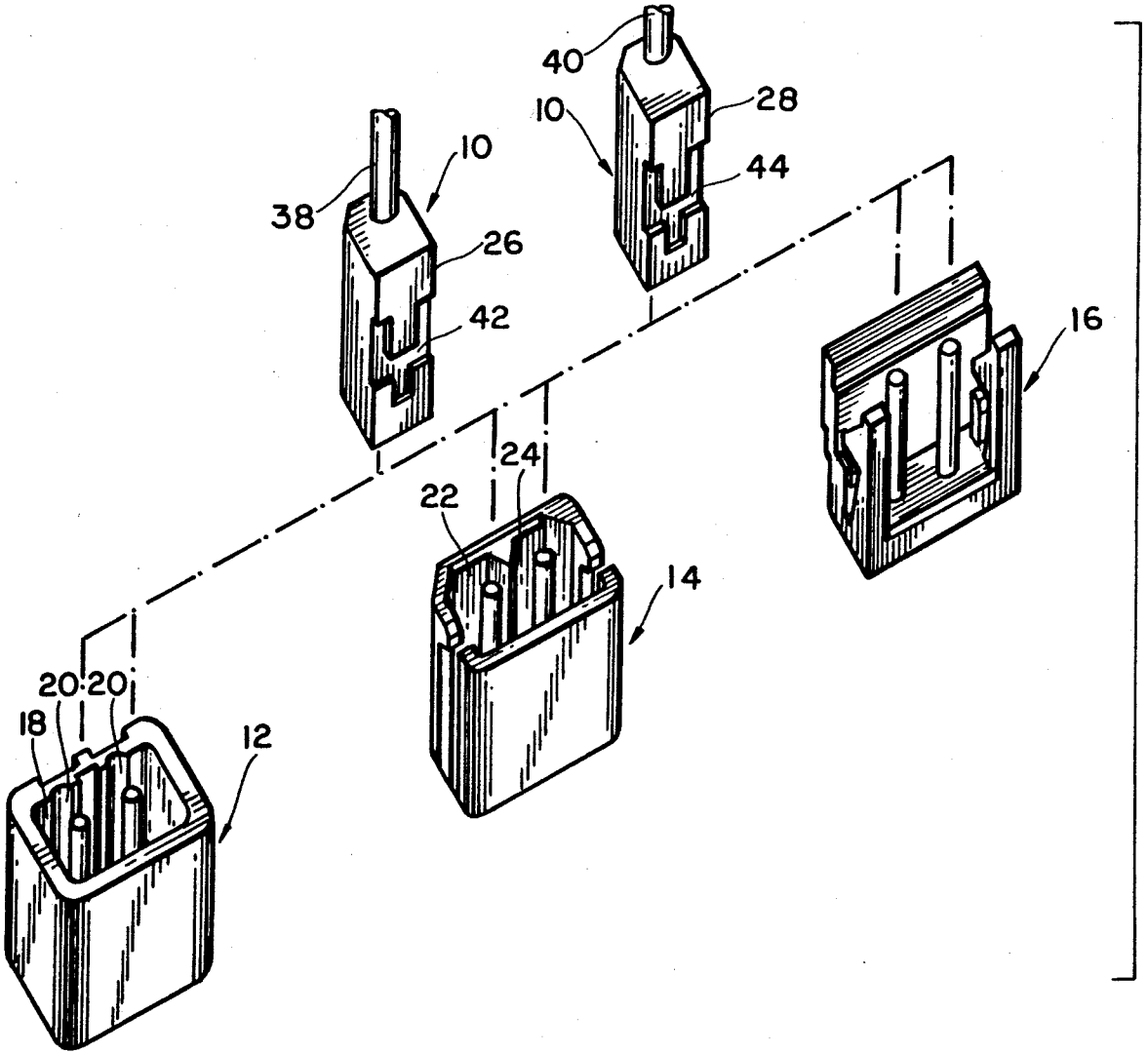
FIG. 1 is a schematic representation of a universal plug constructed in accordance with the invention and illustrating its ability to cooperate with electric receptacles of substantially different configurations, such as receptacles made respectively by Mitsumi, Molex and JST.

FIG. 1 shows a universal plug 10 constructed in accordance with the invention and intended for electrical connection with a receptacle 12, 14 or 16. The manner in which the plug 10 cooperates with the receptacles 12, 14 and 15 is shown respectively in FIGS. 2, 3 and 4. Each of the receptacles 12, 14 and 16 has a configuration selected from a plurality of different configurations such that a conventional electric plug that mates properly with a receptacle having a first of the configurations is prevented from mating properly with a receptacle having a second of the configurations. For example, the receptacle 12, known as a Mitsumi M60 series receptacle, has a wall 18 formed with grooves 20 and 21, while the receptacle 14, known as a Molex S267-NA series receptacle, has a wall 22 formed with a ridge 24. A conventional plug intended to cooperate with the Mitsumi receptacle is formed with ridges that can be received slidably in the grooves 20 and 21 but that prevent such a plug from being inserted in the Molex receptacle. Conversely, the ridge 24 of the Molex receptacle prevents the Mitsumi plug from being inserted in the Molex receptacle. Similarly, as FIGS. 1 and 4 show, the receptacle 16, known as a JST EHR series receptacle, has a geometry that is different from both the Mitsumi and Molex receptacles.

As those skilled in the art know, a result of these different configurations is that a Mitsumi-type plug can be used only with a Mitsumi receptacle, a Molex-type plug can be used only with a Molex receptacle, and a JST-type plug can be used only with a JST receptacle.

In accordance with the invention, the universal plug 10 is formed with a first plug component 26 and a second plug component 28. The first and second components 26 and 28 are separable from each other, as illustrated in FIG. 1, so that each can be manipulated independently of the other for electrical connection to any of the receptacles 12, 14 and 16, whereby the universal plug 10 will mate properly with a receptacle of a first configuration (for example, the configuration of the Mitsumi receptacle), and will also mate properly with a receptacle of a second configuration (for example, a Molex-type or JST-type receptacle).

Figure 4:
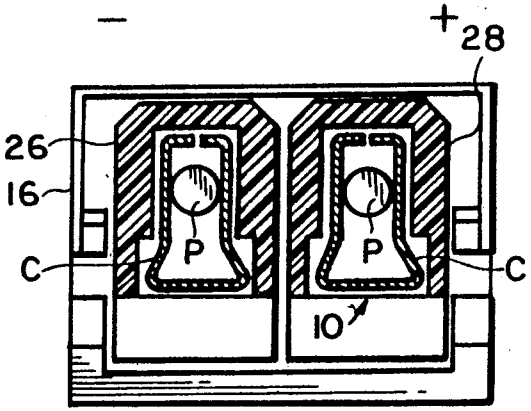
FIGS. 2, 3 and 4 are sectional views taken in a plane perpendicular to the planes of the receptacle pins and showing a universal plug in accordance with the invention inserted respectively in the Mitsumi, Molex and JST receptacles.
Figure 3:
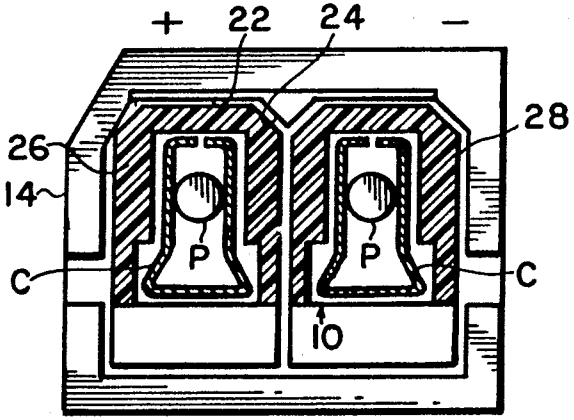
Figure 2:
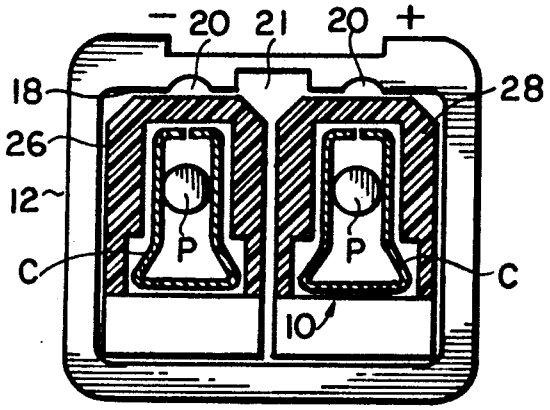

FIGS. 2, 3 and 4 show the manner in which the plug components 26 and 28 fit properly within receptacles of the Mitsumi, Molex and JST configurations. These figures show clearly the receptacle pins P and female contact C by which electrical contact is established between the receptacle and the universal plug.

Figure 7:
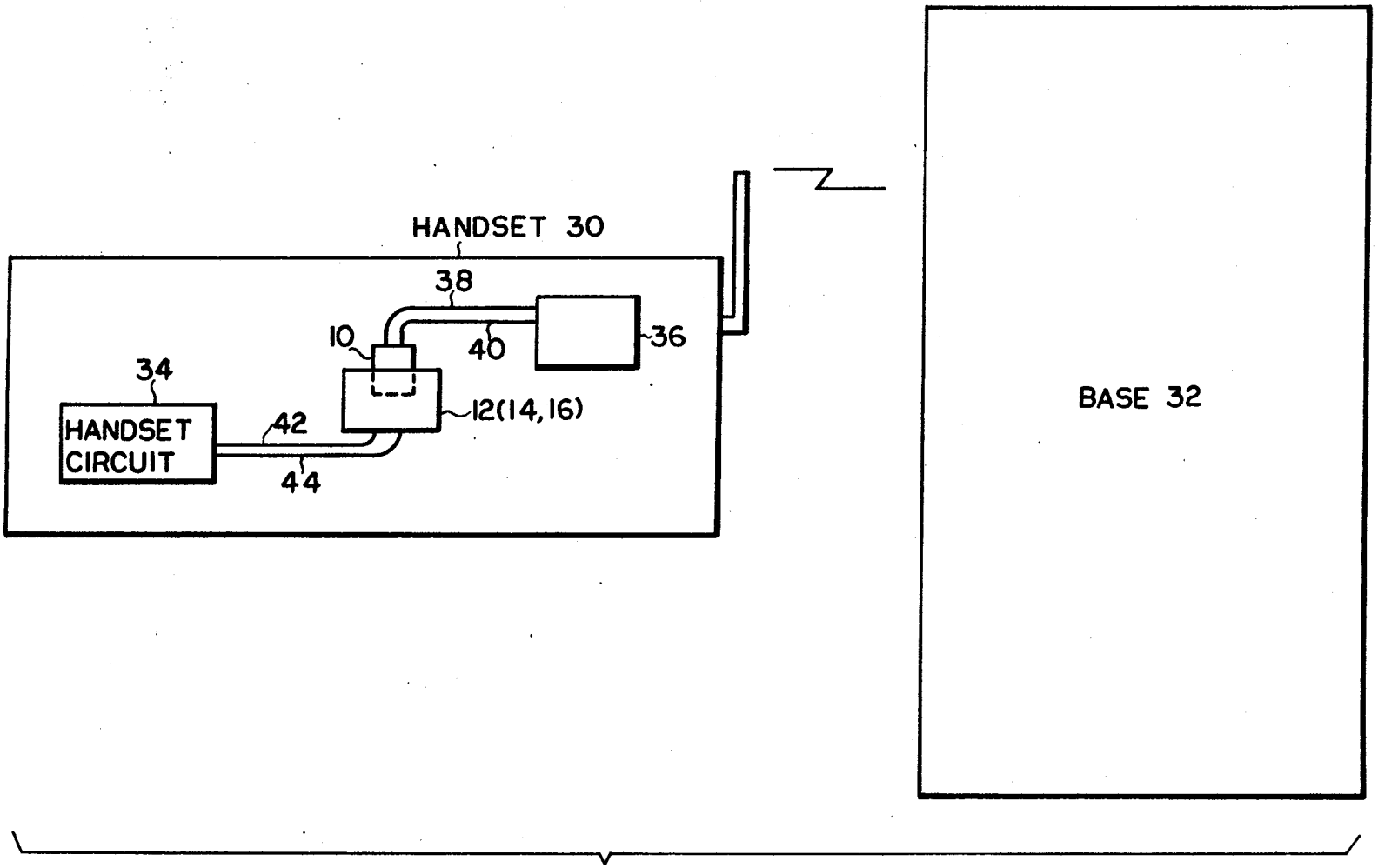
FIG. 7 is a schematic view of a universal plug according to the invention incorporated in the handset of a cordless telephone.

The invention has particular application for use with a handset of a cordless telephone as represented schematically in FIG. 7. The handset 30 cooperates with a base 32 and incorporates the plug 10, a receptacle 12, 14 or 16 electrically connected to the plug, handset circuitry 34, rechargeable battery means such as a battery pack 36 for powering the handset circuitry 34, first and second battery leads 38 and 40 connecting the battery pack 36 to the plug 10, and first and second circuit leads 42 and 44 connecting the handset circuitry 34 to the receptacle 12, 14 or 16. The handset 30 is of a design selected from a plurality of designs such that the receptacle 12, 14 or 16 of a cordless telephone of a first of the designs is configured differently from the receptacle 12, 14 or 16 of a cordless telephone of a second of the designs so that a conventional plug that mates properly with a receptacle of a cordless telephone of the first design is prevented from mating properly with a receptacle of a cordless telephone of the second design.

The improvement illustrated in FIG. 7 is, as explained above, that the plug is formed with a first plug component 26 connected to the first battery lead 38 (see also FIG. 1) and a second plug component 28 connected to the second battery lead 40, the first and second plug components 26 and 28 being separable from each other so that each can be manipulated independently for electrical connection to the receptacle.

Thus the plug 10 will mate properly with a receptacle of a cordless telephone of the first design and will also mate properly with a receptacle of a cordless telephone of the second design.

Figure 6:
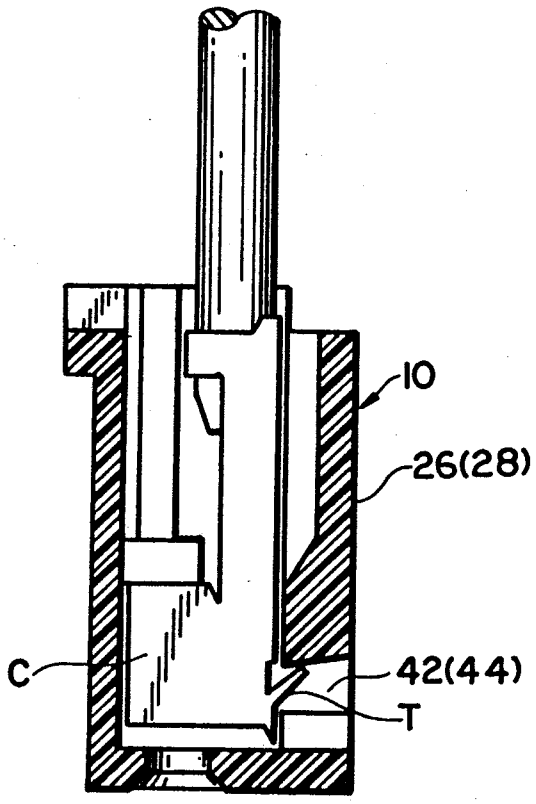
FIG. 6 is a sectional view taken along the line 6—6 of FIG. 5 and looking in the direction of the arrows.
Figure 5:
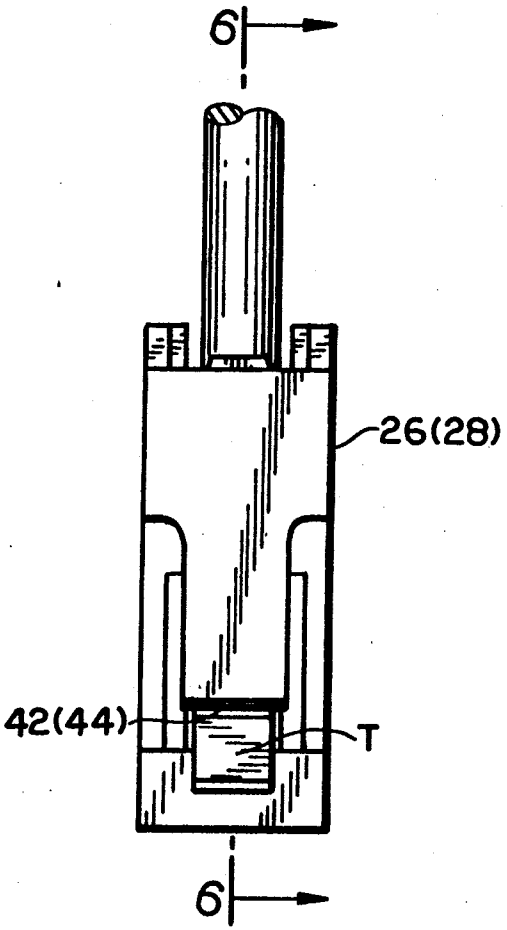
FIG. 5 is a view in elevation of a universal plug in accordance with the invention.

The plug components 26 and 28 are formed with cutout sections 42 and 44, respectively. The plug components are formed of a plastic material constituting a casing for the lower ends of the battery wires, and the cutout sections 42 and 44 provide an anchor for the metal tongue section which has a backwardly-directed tongue or bar T (see also FIGS. 5 and 6). Once inserted into position, it is not possible to dislodge the metal tongue from the plastic section by pulling on the wire 38 or 40.

Thus there is provided in accordance with the invention a novel and highly-effective universal electric plug that will mate properly with electric receptacles that respectively have substantially different configurations. The invention solves the problems of the prior art and attains the objects outlined above. Many modifications of the preferred embodiment of the invention disclosed herein will readily occur to those skilled in the art. For example, what has been described as a receptacle may be attached to the battery leads, and what has been described as a universal plug may be connected to the leads extending to the handset electric circuitry. Accordingly, the invention is not limited except by the appended claims.

We claim:

1. A universal electric plug for electrical connection with a receptacle, said receptacle having a configuration selected from a plurality of different configurations such that a conventional electric plug that mates properly with a receptacle having a first of said configurations is prevented from mating properly with a receptacle having a second of said configurations, and said universal plug being formed with a first plug component and a second plug component, said first and second components being separable from each other so that each can be manipulated independently of the other for electrical connection to said receptacle, electrical connection of only said first plug component to said receptacle failing to complete an electric circuit and electrical connection of only said second plug component to said receptacle also failing to complete an electrical circuit but electrical connection of both of said plug components to said receptacle completing an electric circuit, whereby said universal plug will mate properly with a receptacle of said first configuration and will also mate properly with a receptacle of said second configuration

2. A universal electric plug according to claim 1 wherein each of said plug components is formed with a cutout section to provide an anchor for a metal tongue to prevent dislodgement of the metal tongue from the plug component.

3. A universal electric plug according to claim 1, wherein said receptacle of said first configuration is a Mitsumi M60 series receptacle and said receptacle of said second configuration is a Molex S267-NA series receptacle or a JST EHR series receptacle.

4. A universal electric plug according to claim 1, wherein said receptacle of said first configuration is a Molex S267-NA series receptacle and said receptacle of said second configuration is a Mitsumi M60 series receptacle or a JST EHR series receptacle.

5. A universal electric plug according to claim 1, wherein said receptacle of said first configuration is a JST EHR series receptacle and said receptacle of said second configuration is a Mitsumi M60 series receptacle or a Molex S267-NA series receptacle.

6. In an electric plug for sue with a handset of a cordless telephone wherein the handset (a) incorporates the plug, a receptacle electrically connected to the plug, handset circuitry, rechargeable battery means for powering the handset circuitry, first and second battery leads connecting the battery means to the plug, and first and second circuit leads connecting the handset circuitry to the receptacle and (b) is of a design selected from a plurality of designs such that the receptacle of a cordless telephone of a first of said designs is configured differently form the receptacle of a cordless telephone of a second of said designs so that a conventional plug that mates properly with a receptacle of a cordless telephone of said first design is prevented from mating properly with a receptacle of a cordless telephone of said second design, the improvement wherein the plug is formed with a first plug component connected to said first battery lead and a second plug component connected to said second battery lead, said first and second plug components being separable from each other so that each can be manipulated independently for electrical connection to said receptacle, electrical connection of only said first plug component to said receptacle failing to complete an electric circuit and electrical connection of only said second plug component to said receptacle also failing to complete an electric circuit but electrical connection of both of said plug components to said receptacle completing an electric circuit, whereby said plug will mate properly with a receptacle of a cordless telephone of said first design and will also mate properly with a receptacle of a cordless telephone of said second design.

7. A universal electric plug according to claim 6 wherein each of said plug components is formed with a cutout section to provide an anchor for a metal tongue to prevent dislodgement of the metal tongue form the plug component.

8. A universal electric plug according to claim 6, wherein said receptacle of a cordless telephone of said first design is a Mitsumi M60 series receptacle and said receptacle of a cordless telephone of said second design is a Molex S267-NA series receptacle or a JST EHR series receptacle.

9. A universal electric plug according to claim 6, wherein said receptacle of a cordless telephone of said first design is a Molex S267-NA series receptacle and said receptacle of a cordless telephone of said second design is a Mitsumi M60 series receptacle or a JST EHR series receptacle.

10. A universal electric plug according to claim 6, wherein said receptacle of a cordless telephone of said first design is a JST EHR series receptacle and said receptacle of a cordless telephone of said second design is a Mitsumi M60 series receptacle or a Molex S267-NA series receptacle.

* * * * *